United States Patent [19]

Hruby, Jr.

[11] 4,055,302

[45] Oct. 25, 1977

[54] LIQUID SPRAY NOZZLE HAVING A RANDOMLY DIRECTIONALLY UNSTABLE DISCHARGE CHARACTERISTIC AND COUNTERFLOW INTERNAL FLOW PATTERN

[75] Inventor: John O. Hruby, Jr., Burbank, Calif.

[73] Assignee: Rain Jet Corporation, Burbank, Calif.

[21] Appl. No.: 706,464

[22] Filed: July 19, 1976

[51] Int. Cl.[2] ..... B05B 1/08

[52] U.S. Cl. ..... 239/102; 239/DIG. 16; 239/590.5

[58] Field of Search ..... 239/DIG. 16, 17, 101, 239/102, 589, 590, 590.5, 498–500, 443

[56] References Cited

U.S. PATENT DOCUMENTS

| | | | |
|---|---|---|---|
| 3,018,969 | 1/1962 | Gentry | 239/443 X |
| 3,221,996 | 12/1965 | Emmert et al. | 239/590 X |
| 3,684,176 | 8/1972 | Hruby, Jr. | 239/101 |
| 3,897,003 | 7/1975 | Zehr | 239/499 X |

*Primary Examiner*—Robert W. Saifer

*Attorney, Agent, or Firm*—Christie, Parker & Hale

[57] ABSTRACT

A liqud discharge nozzle for producing a randomly directionally unstable liquid discharge characteristic includes a body having a chamber therein. An inlet is provided to the chamber. An outlet duct is defined from an end of the chamber to the exterior of the body. The chamber, the inlet and the outlet duct are cooperatively related so that the direction of liquid flow into the chamber is substantially opposite to the direction of liquid flow from the chamber and so that the liquid flow characteristic through the outlet duct is linear. The outlet duct has a straight constant diameter first portion communicating from the chamber to a flared second portion of the outlet duct. The duct first portion has a ratio of length to diameter in the range from about one-third to about 18. The diameter of the duct second portion increases proceeding away from the chamber from an initial diameter essentially equal to that of the duct first portion.

27 Claims, 8 Drawing Figures

LIQUID SPRAY NOZZLE HAVING A RANDOMLY DIRECTIONALLY UNSTABLE DISCHARGE CHARACTERISTIC AND COUNTERFLOW INTERNAL FLOW PATTERN

CROSS REFERENCE TO RELATED APPLICATIONS

The invention described and claimed in the present application is related to the invention described and claimed in my copending application Ser. No. 706,466 filed on the same day as this application and assigned to the same assignee. My copending application Ser. No. 706,465, also filed on the same date as this application and assigned to the same assignee, describes the use of nozzles in accordance with this invention in the context of a shower head or similar water discharge device.

BACKGROUND OF THE INVENTION

1. Field of the Invention

This invention relates to liquid spray nozzles. More particularly, it relates to nozzles in which the liquid discharge is randomly directionally unstable over a wide range of applied liquid pressures.

2. Review of the Prior Art and General Background

My prior U.S. Pat. No. 3,684,176 describes a liquid discharge nozzle which is arranged to produce a discharge which pulsates randomly in intensity and in which the principal discharge trajectory oscillates randomly within a basic conical limiting envelope defined by the nozzle structure. This then-novel discharge characteristic, as set forth in the patent, is produced when the nozzle has an elongate inner chamber, a restricted inlet to the chamber at one end thereof, and a single outlet duct from the chamber having an area much less than the mean transverse area of the chamber but greater than the inlet area and also a conically flared outlet end. In such a nozzle, the inlet to the chamber is formed through a plug-like septum at the inlet end of the chamber. Thus, according to my prior patent, the desired discharge characteristic described therein required the use of a nozzle having an inlet to and an outlet duct from the chamber, the inlet and the outlet each having an area less than cross-sectional area of the chamber with the outlet duct being of greater area than the inlet; the prior nozzle also required a conical flare on the outer end of the outlet duct.

Nozzle structures in accord with the teachings and descriptions of my prior U.S. Pat. No. 3,684,176 function to produce a randomly directionally unstable discharge characteristic only when the liquid (typically water) applied to the nozzle is at relatively high pressure of about 25 pounds per square inch gage pressure or more; these nozzles produce this discharge characteristic for all applied water pressures greater than the threshold pressure associated with the initial manifestation of the unique discharge effect.

Shortly following the filing of the patent application which resulted in U.S. Pat. No. 3,684,176, and before the issuance of the patent on that application, I undertook a research and development program in an effort to produce a nozzle structure which would produce this unique discharge characteristic when the applied water pressure was relatively low, say on the order of 5 psig or less, and which would maintain the discharge characteristic over a wide range of higher applied water pressures. This research and development program extended for approximately five years. I commenced this research and development program because I discerned a need for nozzles of the nature which the program sought to produce. Nozzles of such nature can be used in shower heads as well as in liquid discharge devices for industrial purposes.

In the course of this research and development program, I found that I could make most any nozzle structure, defined in accordance with the teachings of my prior patent, function to produce the randomly directionally unstable discharge characteristic if the nozzle structure included an inlet choke (i.e., the inlet opening to the chamber was defined through a septum at the inlet end of the chamber) and if the inlet opening had an effective water flow area less than the effective water flow area of the outlet duct from the chamber. I was unable, until making the discovery which is an aspect of the present invention, to produce a nozzle structure in accord with my prior patent which operated reliably to produce the desired discharge characteristic when operated over a wide range of applied water pressures beginning at about 5 psig or less. The problem which I encountered with nozzles structured according to the descriptions of my prior patent was one of pressure loss and inefficiency due to the effects of the restricted inlet to the chamber within the nozzle. In an attempt to reduce pressure loss through the nozzle and to improve the liquid discharging efficiency of the nozzle structure, the inlet opening of the prior nozzle was made larger than the area of the outlet duct, but I found that this structural variation caused a loss of any ability to predictably produce the desired discharge characteristic over the desired wide range of water pressure. In other words, as the inlet opening to the chamber was enlarged to be equal to or greater than the area of the outlet duct from the chamber to the exterior of the nozzle, the ability to produce a reliable operating nozzle having a reliably predictable discharge oscillation threshold pressure became a random occurrence.

I have now discovered that the randomly directionally unstable discharge characteristics of the type produced by nozzles described in my prior patent 3,684,176 can be obtained predictably in nozzle structures which have no flow-restricting plug-like septum across the interior of the nozzle body and through which the inlet is defined to the chamber from which the outlet duct communicates. In the "plugless" or "unchoked" nozzles to which this patent application is addressed, the desired randomly directionally unstable discharge characteristic is accomplished in a predictable manner over a wide range of pressures, beginning at low pressures on the order of 5 psig or less, by the proportioning and geometry of the outlet duct from the nozzle. One aspect of the present invention is the recognition that the relationships and structural features described in U.S. Pat. No. 3,684,176 are, in effect, a special case, which in some respects is an optimum case, of broader relationships which can be used to produce the same result. This invention removes limitations from the technology and art pertinent to nozzles of the type described in my prior patent, and thereby advances the pertinent technology and art.

I have also discovered that nozzles of the type described in my prior patent are not readily scalable from one size to another, particularly into small size nozzles. It is believed that this difficulty in downward scaling of nozzles according to my prior patent is due, at least in part, to the increasing significance and effect of liquid viscosity as the size of the nozzle is reduced.

The prior art specifically considered in the preparation of this patent application includes the following U.S. Pat Nos. 487,628; 604,873; 1,104,965; 1,762,313; 1,940,171; 1,983,634; 2,106,427; 2,175,160; 2,295,228; 2,550,573; 2,573,982; 2,735,719; 2,978,189; 3,003,548; 3,045,932; 3,054,563; 3,178,121; 3,198,442; 3,230,924; 3,240,253; 3,263,934; 3,300,142; 3,314,612; 3,326,473; 3,337,135; 3,423,026; 3,469,642; 3,490,696; 3,628,726; 3,643,866; 3,666,183; 3,675,855; 3,684,176; 3,687,369; 3,747,859; 3,750,961; 3,756,575; 3,774,846; 3,810,583; 3,823,408; and 3,884,417.

SPECIAL BACKGROUND OF THIS INVENTION

For an understanding of this invention in the context of the prior art, including that reflected by the above-listed patents, it is important to bear in mind the distinction between liquids, on the one hand, and gases, on the other hand, as opposed to the overall generic descriptive term "fluid" which is sufficiently broad to apply to both liquids and gases. This invention is concerned with liquid discharge nozzles; it is not concerned with nozzles or other structures for discharging or dispensing gases or mixtures of gases and liquids. In the context of liquid discharge nozzles, this invention is concerned with the production of a particular discharge characteristic in which, for given condition of applied liquid flow rate and pressure, the quantity of liquid discharged does not vary from time to time, but which manifests a randomly directionally unstable discharge pattern. That is, this invention is concerned particularly with the production of a liquid discharge nozzle in which the instantaneous trajectory of the principal quantity of liquid discharged from the nozzle varies randomly in angular orientation relative to the axis of the outlet duct of the nozzle, and in which the instantaneous line of principal discharge in always within an encompassing envelope of generally conical configuration defined by the nozzle structure itself. In other words, in a nozzle of the type to which this invention is specifically addressed, the discharge from the nozzle is a liquid (typically water) and, beginning at a relatively low applied pressure of say 5 pounds psig or less through a wide range of pressures, is so defined that, at any given instant, the direction of movement of the principal portion of the liquid discharged from the nozzle is randomly indeterminate but lies along a line within an enveloping cone. In nozzles of this type, there is generally at any given instant, some discharge along all potential discharge lines within the enveloping cone, the principal portion of the discharge being predominantly along one line whose attitude or relationship angularly to the axis of the outlet duct varies at a characteristic frequency which is defined principally by the geometry and proportioning of the outlet duct from the nozzle rather than by the applied liquid pressure.

This invention proceeds from the discovery which is described in detail in my copending application Ser. No. 706,466. That discovery is that an unchoked nozzle having the desired liquid discharge characteristic can be produced when the nozzle outlet duct from a chamber in the nozzle has a straight constant diameter throat portion from the chamber, and when the outlet duct has a flared second portion at the outlet end of the throat. The throat has ratio of length to diameter in the range of from about 4 to about 18. The flare is defined so that the duct area increases proceeding from the throat toward the exterior of the nozzle. While the ultimate flare angle of the outlet duct second portion relative to the axis of the throat may exceed 6°, if the ultimate flare angle is greater than 6° the duct throat and flare portions are coupled directly by a transition in which the flare angle is developed in at least one transition section having a flare angle in the range of from about 2° to not more than 6°. The inlet to the chamber has a liquid flow area at least as great as the minimum liquid flow area of the outlet duct.

In some applications, this discovery results in a nozzle arrangement which is inconveniently long. An axially more compact liquid discharge nozzle is desired in many applications. This invention is addressed to this need.

SUMMARY OF THE INVENTION

This invention provides a liquid discharge nozzle having the same desirable discharge characteristic as the nozzle described in my copending application Ser. No. 706,466, but in a structure which is axially more compact than such a nozzle. A nozzle according to the present invention can have an outlet duct configured precisely the same as the outlet duct in a nozzle as described in the copending application, but it can also be much shorter. This invention enables the use of a nozzle in which the length to diameter ratio of the outlet duct throat may be as small as one-third without impairment of the desired discharge characteristic.

Generally speaking, this invention provides a liquid discharge nozzle for producing a randomly directionally unstable discharge of the type specifically identified above. The nozzle includes a body which defines therein a chamber having a liquid inlet to the chamber and a liquid outlet duct from the chamber to the exterior of the body. The liquid flow area of the inlet to the chamber is at least as great as, and can be greater than, the minimum liquid flow area of the outlet duct. The chamber is defined cooperatively with the inlet and with the outlet duct for substantially linear flow of liquid through the outlet duct during operation of the nozzle and for flow of liquid into the chamber in a direction substantially opposite to the direction of liquid flow from the chamber through the outlet duct. The outlet duct has a straight throat portion of constant diameter which communicates from the chamber to a flared second portion of the duct. The duct throat portion has a ratio of length to diameter in the range from about $\frac{1}{3}$ to about 18. The diameter of the duct second portion increases, proceeding along the duct from the chamber, from a diameter equal to that of the duct throat portion. The angle of flare of the duct second portion, relative to the axis of the duct throat portion at the intersection of the duct throat and second portions, is at least two degrees and is no greater than 6°.

DESCRIPTION OF THE DRAWINGS

The above-mentioned and other features of this invention are more clearly set forth in the following detailed description of presently preferred embodiments of this invention, which description is presented with reference to the accompanying drawings wherein.

INCORPORATION BY REFERENCE

There is incorporated herein by reference as though fully set forth at this point that portion of the description, together with the drawings illustrating the description, of my copending patent application Ser. No. 706,466, filed concurrently with this application, consisting of the first 25 complete paragraphs of the portion of the specification thereof headed "Description of the Illustrated Embodiments".

DESCRIPTION OF THE ILLUSTRATED EMBODIMENT

Figure 1:
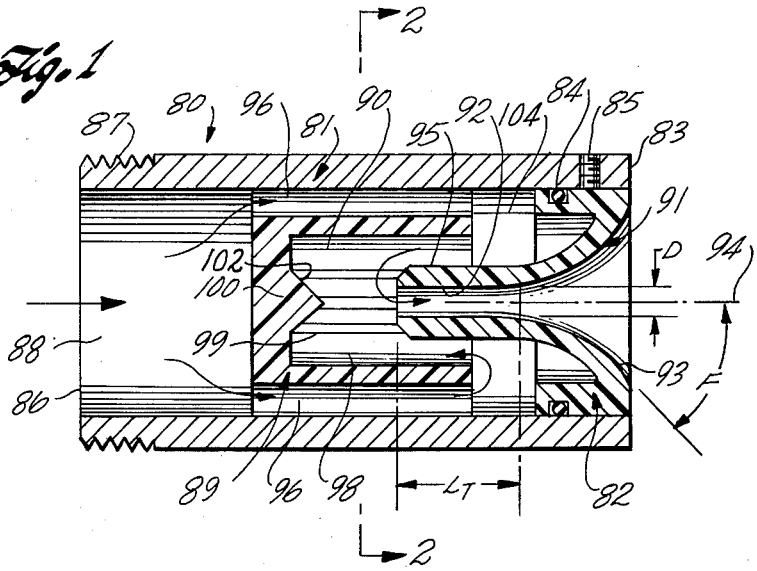
FIG. 1 is a cross-sectional elevation view of a presently preferred liquid discharge nozzle according to this invention.

A liquid discharge nozzle 80 of the impact-effect type, having a randomly directionally unstable discharge characteristic, is shown in FIG. 1 hereof. The impact effect of nozzle 80 is due to its randomly directionally unstable discharge characteristic. Nozzle 80 has a tubular body 81 and an outlet plug 82 engaged with the interior of the body at an outlet end 83 of the nozzle. The cooperation of the plug with the interior of the body tube is made watertight by an O-ring 84 or other suitable seal engaged between the outlet plug 82 and the body tube. The outlet plug is fixed in the body tube by a set screw 85 threaded into the tube and engaged with the outlet plug. The inlet end 86 of the body tube is adapted, as by external threads 87, to be connected to a suitable source of pressurized liquid which is to be discharged by nozzle 80. The inlet end of body 81 is fully open to a cavity 88 defined in the body to the rear of a flow reversing cap 89 which is disposed coaxial with outlet plug 82 and which is engaged with the inlet end of the outlet plug as more fully described below. A chamber 90 is defined inside cap 89, and an outlet duct 91 is defined by the outlet plug from the chamber to the exterior of the nozzle.

Outlet duct 91 has a straight constant diameter throat 92 which communicates directly to chamber 90, and a second flared portion 93 which opens from the outlet end of the throat to the exterior of the nozzle. The throat length is indicated in FIG. 1 by dimensions $L_T$ and its diameter by dimensions D. The ultimate flare angle of duct flare portion 93, as measured relative to throat axis 94, is indicated by angular dimension F.

The flare angle F of the duct flared portion 93 may be more or less than 6°, 6° being an important value which determines how the ultimate flare angle of the outlet duct is developed from and related to the outlet duct throat; in this regard, these aspects of nozzle 80 are in accord with the descriptions of copending application Ser. No. 706,466 incorporated herein by reference. Thus, the flare of the outlet duct may be either arcuate (as shown in FIG. 1 as the preferred arrangement) or linear. The flare angle F can be either a) in the range of from about 2° to 6°, in which case the flare geometry can be but is not required to be linear, i.e., conical and coupled direct to the outlet end of the throat 92 so that the minimum diameter of the outlet duct in the flared portion is equal to the throat diameter, or b) greater than 6° if the flared duct second portion is coupled to the constant diameter throat by a flared transition section in which the transition flare, if of a linear nature, is in the range from ½° to 6° or, if of a non-linear or arcuate nature, is smoothly blended into the constant diameter throat as shown in FIG. 1.

My copending application Ser. No. 706,466, portions of which are incorporated herein, pertains to an unchoked liquid discharge nozzle having the desired randomly directionally unstable discharge characteristic and in which a) the outlet duct flare portion geometry and flare values are as stated above, and b) the length to diameter ratio of the outlet duct throat is in the range of from about 4 to about 18. This ratio of $L_T$:D in the range of from 4 to 18 is pertinent where the liquid flow path through the nozzle is a straight flow path with no reversals of liquid flow direction within the nozzle. As can be seen in FIG. 1 hereof and from the following description, nozzle 80 is arranged so that the liquid flow path into chamber 90 is in a direction substantially opposite to the direction of liquid flow from the chamber through outlet duct 91; in this situation (i.e., in a nozzle according to the present invention), the throat length to diameter ratio can be in the range of from about ⅓ to about 18 because of the effect (which is not fully understood) of flow reversing cap 89.

Outlet plug 82 of nozzle 80 preferably is molded of ABS resin and is of smaller outer diameter at its inlet end than at its outlet end to enable cap 89 to be engaged with the plug within body 81 and to enable applied liquid to flow forwardly between the exterior of the cap and the interior of the body to an annular space 94 between the forward end of the cap and the larger diameter forward end of the outlet plug 82. Throat 92 is defined in the smaller diameter neck 95 which extends rearwardly in the body from the forward end of the body into the cap.

Figure 2:
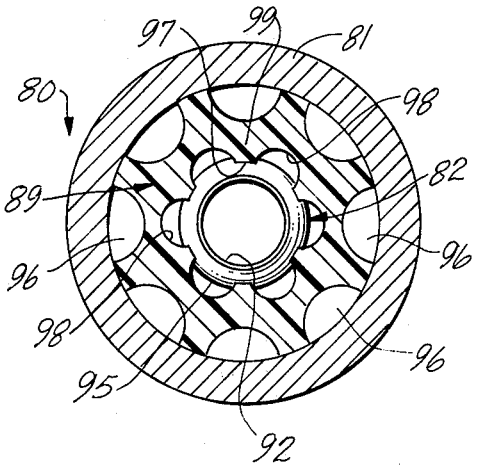
FIG. 2 is a cross-sectional elevation view taken along line 2—2 of FIG. 1.

The preferred arrangement of a flow reversing cap in the present nozzle is shown in FIGS. 1 and 2 as to cap 89. Cap 89 has an outer diameter which cooperates closely with the inner diameter of body 81 as shown in FIG. 2. A plurality of grooves or passages 96 are formed in the exterior of the cap and are aligned parallel to throat axis 94. Passages 96 have an aggregate cross-sectional area at least equal to and preferably greater than the minimum water flow area of outlet duct 91. Passages 96 permit water to flow from cavity 88 to space 104 within the nozzle. The center of the total area of passages 96 is coaxially aligned with the axis of outlet duct 91 so that the inlet to and the outlet from chamber 90 are coaxially aligned.

Chamber 90 within the cap is defined by a central circular bore 97 and by a plurality of flute grooves 98 around the bore (see FIG. 2), the adjacent grooves 98 being separated by ribs 99 which are disposed parallel to the outlet duct axis. The rear end of chamber 90 is closed by a rear wall 100 of the cap. Ribs 99 extend from cap wall 100 to the forward end of the cap. The forward portions of the ribs can be, but need not be relieved slightly, as shown at 101 in FIG. 4, to the diameter of neck 95 to provide a limit on the extent to which the outlet plug neck can be inserted into the cap; if the ribs are not so relieved, then the diameter of bore 97 is defined to make a snug fit with the outer diameter of the outlet plug neck, and the neck is pressed a selected distance into the cap bore to mount the cap to the outlet plug before assembly of the plug into body 81.

The aggregate cross-sectional area of the several flute grooves 98 along the length thereof which extends along the exterior of the plug neck is at least as great as the minimum liquid flow area of outlet duct 91. The cross-sectional area of chamber 90, between the rear end of neck 95 and the cap wall 100 is greater than the minimum flow area of the outlet duct. Thus, the outlet duct defines the minimum liquid flow area in nozzle 80. The flow path upstream of the outlet duct is not restricted to an area less than the area of the outlet duct. As compared to nozzles of the type described in my prior U.S. Pat. No. 3,684,176, nozzle 80 is an unchoked nozzle.

Passages 96 and grooves 98 are uniformly distributed about nozzle axis 94. Also, the passages, the grooves and ribs 99 are parallel to the nozzle axis. Thus, the flow of water into the chamber and from the chamber through the outlet duct throat is linear flow, as opposed to flow spirally along and about the throat axis. Spiral flow of liquid through throat 92 is to be avoided.

The spacing of cap wall 100 from the rear end of neck 95 is not critical. However, the wall should not be located sufficiently close to the neck to restrict the flow area to an area less than the area of the outlet duct throat.

A conical projection 102 is centered on the front face of cap wall 100 and has its apex disposed towards the inlet to throat 92. The base of the projection has a diameter equal to the diameter of bore 97. The presence of this projection, as compared to no projection, results in a nozzle which begins to manifest the desired randomly directionally unstable discharge characteristic at lower applied liquid pressures than otherwise would be the case.

Figure 3:
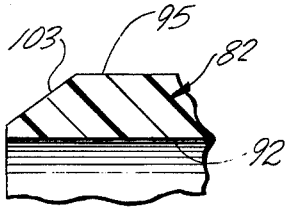
FIG. 3 is an enlarged fragmentary cross-section view, showing a detail of the structure shown in FIG. 1.

As best shown in FIG. 3, it is preferred that the outer edge of neck 95, at its extreme rear ends, be chamfered as at 103 at about a 45° angle. The presence of the chamfer results in a higher frequency of directional change or oscillation in the discharge characteristic than if no chamfer is provided.

Figure 4:
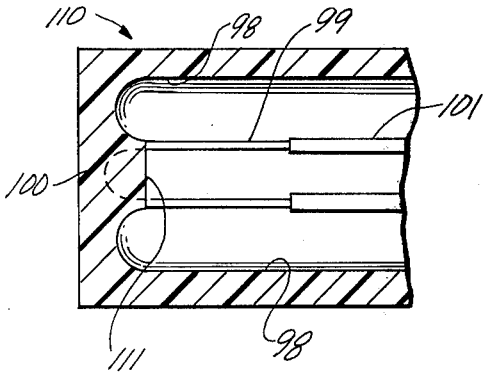
FIG. 4 is a fragmentary cross-section view of another flow-reversing cap in a nozzle according to this invention.

Another cap 110 useful in a nozzle according to this invention is shown in FIG. 4. Cap 110 differs from cap 89 by having an outer diameter equal to the diameter of cap 89 across the bases of exterior grooves 96. The exterior of cap 110 is of cylindrical configuration. Cap 110 is supported in a nozzle solely by its connection to the neck of the outlet plug, and is not also supported by cooperation with the interior of the body. Also, FIG. 4 shows that a flat-topped central projection 111 can be provided on the front face of the cap wall 100 for affecting the characteristic oscillation frequency of the nozzle discharge.

A presently preferred nozzle according to this invention has the following physical properties:

| | |
|---|---|
| outlet throat diameter D | 0.172 in. |
| throat length $L_T$ | 0.600 in. |
| ultimate flare angle F | 10° |
| flare nature | arcuate |
| flare radius of curvature | 3.00 in. |
| cap bore diameter | 0.312 in. |
| plug neck outer diameter | 0.375 in. |
| cap flute groove diameter | 0.1563 in. |
| cap flute groove member | 6 |
| cap flute groove axis from bore axis | 0.187 in. |
| spacing neck rear end from front face of cap wall | 0.400 in. |
| neck extension into cap bore | approx. 0.200 in. |

-continued

| | |
|---|---|
| cap central projection | flat-topped |

This nozzle was operated with water as the applied liquid. The water was obtained from the regular water mains in Burbank, Cal. in August, and was not further treated chemically. The nozzle manifested the desired randomly directionally unstable discharge characteristic at applied water pressure of approximately 2.5 psig and was maintained as applied water pressure was increased to 45 psig which was the maximum pressure obtainable in the test facility.

While the ratio of $L_T/D$ in a nozzle according to this invention can be in the range of from about $\frac{1}{3}$ to about 18, I have found that the most satisfactory discharge characteristics are obtained when this ratio has a value in the range of from about 1 to about 7. $L_T/D$ values between 7 and 18 have little effect on the discharge characteristic, and result only in increased length of the overall nozzle structure. I presently prefer a ratio value of from about 1 to about 4 in nozzles of the type shown in the accompanying drawings for use in shower heads as shown in my copending application Ser. No. 706,465.

In a nozzle according to this invention, steps or shoulders should be avoided in those portions of the outlet duct flared portion which are relied upon to produce the directionally unstable discharge characteristic. Steps or shoulders facing either toward or away from the outlet end of the duct throat can be provided, either in subsequent portions of the duct geometry or in additional structure of the nozzle separate from the structure defining the outlet duct, for whatever purpose may be desired.

The term "conical" has been used above to describe the nature of the flared portion of the outlet ducts in the nozzles referred to. An arcuately flared duct is not truly conical in form, as a cone has straight sides when viewed in elevation. The term "conical" is thus seen to have been used herein to refer to a duct flare which, in all planes normal to the duct axis, has a circular cross-sectional configuration. It will be appreciated, however, that the principles of this invention can be used, without sacrifice of the randomly directionally unstable discharge characteristic, in a nozzle in which the outlet duct flare has an elliptical or other smoothly curved cross-sectional shape in all planes normal to the duct axis; such an elliptically conical flare configuration could be used where the discharge envelope is to be higher than it is wide. Thus, as used herein, including in the following claims, the term "conical" is to be interpreted broadly rather than according to its most precise geometric definition.

Figure 5:
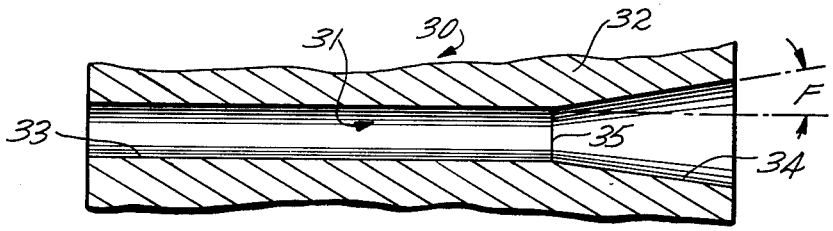
FIG. 5 is a fragmentary enlarged cross-sectional elevation view of another outlet duct arrangement useful in a nozzle of this invention.
Figure 6:
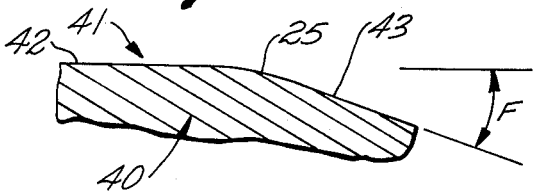
FIG. 6 is a fragmentary cross-section view of another outlet duct configuration.

The general rule which I have discovered, concerning ultimate flare angles of more or less than 6° at the outlet end of the nozzle outlet duct, has been stated above. The applications of this rule are illustrated in FIGS. 5–8. An outlet duct 31 for a nozzle 30, useful in the practice of this invention, is shown in FIG. 5. Outlet duct 31 is defined in a suitable plug or other member 32. The outlet duct has a first straight, constant diameter throat portion 33 having a ratio of length to diameter throat portion 33 having a ratio of length to diameter in the range of about $\frac{1}{3}$ to about 18 as described above. Duct 31 has a linearly flared second portion 34 in which the flare angle F, measured as shown, is no greater than 6° but not less than 2°. The duct flared and straight portions 34 and 33 connect at a discontinuity 35 at the outlet end of the straight throat at which the diameters of duct portions 33 and 34 are equal.

Another nozzle 40 (FIG. 6) has an outlet duct 41 formed in a member to have a straight throat portion 42, a linearly flared second portion 43, and a transition section 25 between portions 42 and 43. The length-to-diameter ratio of the throat is in the range given above. Flare angle F of duct second portion 43 is greater than 6° and may be in the range of from 10° to about 30°. Because angle F is greater than 6°, transition section 25 is provided directly between the duct throat and second portions. In transition section 25, the duct diameter increases non-linearly from that of the throat in such a way that, at its outlet end, the transition section becomes smoothly continuous with the inlet end of the duct second portion. I prefer that the cumulative length along the outlet duct axis of transition section 25 and second portion 43 is at least about two times the diameter of the duct throat portion; I prefer to observe this relationship in any nozzle according to this invention in which a transition section is used to give an ultimate flare angle F greater than 6°.

Figure 7:
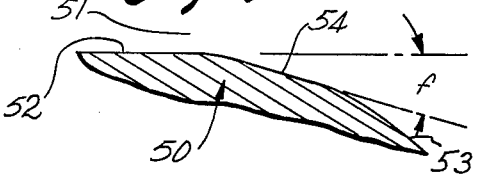
FIG. 7 is a fragmentary cross-section view of still another outlet duct configuration.

FIG. 7 shows a nozzle member 50 defining an outlet duct 51 having a straight throat 52, an arcuately curving flared second portion 53, and a linearly flared transition section 54 between the throat and second portions. The ultimate flare angle of the duct second portion is greater than 6°. Where, as in nozzle 50, the transition section is linearly flared, the transition flare angle f is in the range of from ½° to 6°.

Figure 8:
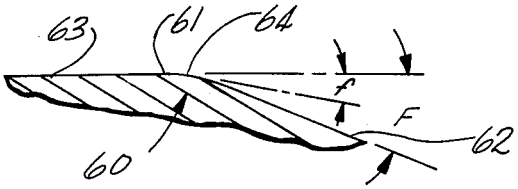
FIG. 8 is a fragmentary cross-section view of yet another outlet duct configuration.

FIG. 8 shows another nozzle 60 in which the outlet duct 61 has a linearly flared second portion 62 connected to the constant diameter throat 63 by a short linear transition section 64, the flare angle F of the second portion being greater than 6°. FIG. 8 shows that the length of the transition section along the outlet duct can be very short, even on the order of a few thousandths of an inch. The flare angle of transistion section 64 is in the range of from ½° to 6°.

Workers skilled in the art to which this invention pertains will recognize that, in light of the foregoing, variations or alterations may be made in the nozzles shown without departing from the scope of this invention. The nozzle arrangements shown and described have been presented by way of example and for the purposes of illustration and do not exhaust all of the forms which the present nozzles may take. Therefore, the foregoing descriptions and examples, rather than being considered as limiting the scope of this invention, should be regarded as showing that this invention is not limited in scope of the precise wording of the following claims.

What is claimed is:

1. A nozzle for producing a randomly directionally unstable liquid discharge comprising a body defining therein a chamber having a liquid inlet thereinto and a liquid outlet duct therefrom to the exterior of the body, the liquid flow area of the inlet to the chamber being at least as great as the minimum liquid flow area of the outlet duct, the liquid inlet to the chamber being defined for flow of liquid into the chamber in a direction substantially opposite to the direction of liquid flow from the chamber through the outlet duct, the chamber being defined cooperatively with the inlet and the outlet duct for substantially linear flow of liquid through the outlet duct during operation of the nozzle, the outlet duct having an straight throat portion of constant diameter communicating from the chamber to a flared section portion of the duct, the duct throat portion having a ratio of length to diameter in the range from about ⅓ to about 18, the diameter of the duct second portion increasing proceeding along the duct from the chamber from a diameter equal to that of the duct throat portion, the angle of flare of the duct second portion relative to the axis of the throat at the intersection of the duct throat and second portions being at least 2° and no greater than 6°.

2. A nozzle according to claim 1 wherein the throat length to diameter ratio is in the range of from about 1 to about 7.

3. A nozzle according to claim 1 wherein the throat length to diameter ratio is in the range of from about 1 to about 4.

4. A nozzle according to claim 1 wherein the chamber has a wall spaced from the inlet end of the outlet throat, and including a projection extending from the wall along the throat axis toward the throat inlet.

5. A nozzle according to claim 1 wherein the projection is conical.

6. A nozzle according to claim 1 wherein the outlet throat is defined through a tubular neck, and the inlet to the chamber is defined along the exterior of the neck for flow of liquid into the chamber along a path substantially parallel to the outlet throat.

7. A nozzle according to claim 6 wherein the chamber is defined within a cap member, and the neck extends partially into the cap member.

8. A nozzle according to claim 7 wherein the cap member is supported by the neck.

9. A nozzle according to claim 7 wherein the liquid flow area of the inlet to the chamber is distributed substantially uniformly about the circumference of the neck.

10. A liquid discharge nozzle according to claim 1 wherein the diameter of the duct second portion increases linearly proceeding along the duct axis from the outlet end of the duct throat portion.

11. A liquid discharge nozzle according to claim 1 wherein the diameter of the duct second portion increases non-linearly proceeding along the duct axis from the outlet end of the duct throat portion.

12. A liquid discharge nozzle according to claim 1 wherein the nozzle includes a flared outlet duct third portion coupled to the duct throat portion by the duct second portion, the diameter of the duct increasing proceeding along the duct axis from the duct second portion, the angle of flare of the duct third portion at the end thereof remote from the duct second portion being greater than 6°.

13. A liquid discharge nozzle according to claim 12 wherein the diameter of the duct along the third portion thereof increases linearly proceeding away from the duct second portion.

14. A liquid discharge nozzle according to claim 13 wherein the diameter of the duct second portion increases linearly proceeding along the duct axis from the outlet end of the duct throat portion.

15. A liquid discharge nozzle according to claim 13 wherein the diameter of the duct second portion increases non-linearly proceeding along the duct axis from the outlet end of the duct throat portion.

16. A liquid discharge nozzle according to claim 12 wherein the diameter of the duct along the third portion thereof increases non-linearly proceeding away from the duct second portion.

17. A liquid discharge nozzle according to claim 16 wherein the diameter of the duct second portion increases linearly proceeding along the duct axis from the outlet end of the duct first portion.

18. A liquid discharge nozzle according to claim 16 wherein the diameter of the duct second portion increases non-linearly proceeding along the duct axis from the outlet end of the duct throat portion.

19. A liquid discharge nozzle according to claim 1 wherein the length of the duct second portion along the duct axis is at least about 2 times the diameter of the duct throat portion.

20. A liquid discharge nozzle according to claim 1 wherein the flare of the outlet duct between the second portion thereof and the exterior of the body is at least as great as the flare of the outlet duct in the second portion thereof.

21. A liquid discharge nozzle according to claim 1 wherein the inlet and the outlet duct are coaxially aligned.

22. A nozzle for producing a randomly directionally unstable liquid discharge comprising a body defining therein a chamber having a liquid inlet thereinto and a liquid outlet duct therefrom to the exterior of the body, the liquid flow area of the inlet to the chamber being at least as great as the minimum liquid flow area of the outlet duct, the liquid inlet to the chamber being defined for flow of liquid into the chamber in a direction substantially opposite to the direction of liquid flow from the chamber through the outlet duct, the chamber being defined cooperatively with the inlet and the outlet duct for substantially linear flow of liquid through the outlet duct during operation of the nozzle, the outlet duct having a straight throat portion of constant diameter communicating from the chamber to a flared second portion of the duct, the duct throat portion having a ratio of length to diameter in the range from about $\frac{1}{3}$ to about 18, the diameter of the duct second portion increasing proceeding along the duct from the chamber from a diameter equal to that of the duct throat portion, the angle of flare of the duct second portion relative to the axis of the duct throat portion at the end of the duct second portion remote from the duct throat portion being greater than 6°, the duct throat and second portions being coupled by a flared transition section in which the angle of flare of the duct is not greater than 6°, the diameter of the inlet end of the duct transition section and the outlet end of the duct throat portion being equal.

23. A liquid discharge nozzle according to claim 22 wherein the diameter of the duct second portion increases non-linearly proceeding along the duct axis from the outlet end of the duct throat portion.

24. A liquid discharge nozzle according to claim 23 wherein the diameter of the outlet duct along the transition and second portions thereof increases smoothly and without discontinuity.

25. A liquid discharge nozzle according to claim 22 wherein the cumulative length along the outlet duct axis of the transition section and the second portion is at least about two times the diameter of the duct throat portion.

26. A liquid discharge nozzle according to claim 22 wherein the flare of the outlet duct between the second portion thereof and the exterior of the body is at least as great as the flare of the outlet duct in the second portion thereof.

27. A liquid discharge nozzle according to claim 22 wherein the inlet and the outlet duct are coaxially aligned.

* * * * *